US010232275B2

(12) United States Patent
Theiner

(10) Patent No.: US 10,232,275 B2
(45) Date of Patent: Mar. 19, 2019

(54) YO-YO HAVING A MAGNETICALLY SUPPORTED BEARING YOKE INTEGRATED WITH THE AXLE

(71) Applicant: Thomas Frederick Theiner, Allentown, PA (US)

(72) Inventor: Thomas Frederick Theiner, Allentown, PA (US)

( * ) Notice: Subject to any disclaimer, the term of this patent is extended or adjusted under 35 U.S.C. 154(b) by 0 days.

(21) Appl. No.: 15/932,371

(22) Filed: Feb. 16, 2018

(65) Prior Publication Data

US 2018/0229131 A1 Aug. 16, 2018

Related U.S. Application Data

(60) Provisional application No. 62/459,748, filed on Feb. 16, 2017.

(51) Int. Cl.
*A63H 1/30* (2006.01)
*A63H 33/26* (2006.01)

(52) U.S. Cl.
CPC ..... *A63H 1/30* (2013.01); *A63H 33/26* (2013.01)

(58) Field of Classification Search
CPC ..... A63H 1/30
See application file for complete search history.

(56) References Cited

U.S. PATENT DOCUMENTS 3,326,610 A * 6/1967 Baermann ..... F16C 32/0427 310/90.5
4,382,245 A * 5/1983 Harrigan ..... H01F 7/0236 181/0.5
5,506,459 A * 4/1996 Ritts ..... A63H 1/00 310/90.5
6,162,109 A * 12/2000 Baier ..... A63H 1/30 446/247
8,053,940 B2 * 11/2011 McCulley ..... H02K 53/00 310/113
8,764,509 B1 * 7/2014 Lytle ..... A63H 1/30 446/250
9,440,157 B1 * 9/2016 Cai ..... A63H 29/22

* cited by examiner

*Primary Examiner* — John Ricci

(57) ABSTRACT

A yo-yo having improved spin time is disclosed. The yo-yo has a body comprising two side members joined together at their centers by a fixed axle. A yoke for receiving a string in winding relation is magnetically supported for substantially frictionless rotation about the axle. A pair of radially-magnetized ring magnets disposed at opposite ends of the yoke are received within a corresponding pair of radially-magnetized ring magnets disposed within recesses in the side members. A pair of axially-magnetized ring magnets disposed at opposite ends of the yoke confront a corresponding pair of axially-disposed ring magnets set into the body side members. The magnets are magnetically polarized such that they mutually repel each other. As a result, the yo-yo is free to spin around the yoke for an extended period of time.

11 Claims, 7 Drawing Sheets

YO-YO HAVING A MAGNETICALLY SUPPORTED BEARING YOKE INTEGRATED WITH THE AXLE

CROSS-REFERENCE TO RELATED APPLICATIONS

This application claims the benefit of U.S. Provisional Application No. 62/459,748, filed Feb. 16, 2017, which is hereby incorporated by reference in its entirety as if fully set forth herein.

FIELD OF THE INVENTION

The present invention relates to the field of yo-yos to be used in competition or for personal novelty. In particular, the present invention relates to a means for increasing and maintaining the sleep or dwell time of a yo-yo by having a magnetically-supported bearing yoke integrated with a fixed axle. The invention uniquely defines the use of ring magnets (vs. bar magnets) that have north and south poles, as do bar magnets, but the ring magnet is curved, with an open center, such that the poles lie in the same plane. Basic ring magnets without any additional machining can be magnetized with their north and south poles on opposite circular faces, such as the axially-magnetized ring magnets 504, 505, 506, and 507 of FIGS. 5A, 5B, 6A, and 6B. A true radially-magnetized ring magnet has unique poles (south (S)/north (N)), for example, such as the ring magnets 500, 501, 502, and 503 of FIGS. 5A, 5B, 6A, and 6B, in which the south pole is on the outside circumference and the north pole is on the inside circumference of the rings. Both of these uniquely magnetized configurations are used in the present invention to gain unique magnetic direction and strength. In addition, the present invention takes advantage of the novel properties of true neodymium-containing ring magnets, as it is unique and orients itself so that its south pole substantially repels the south pole of an adjacent ring magnet. Ring magnets perform at their optimum when their dimensions are within a narrow error limit (+/−0.2%), and the magnetic flux density (measured in gauss or tesla) per magnet is as identical as possible (ideally +/−10 gauss), so as not to cause wobbling. The magnetic flux density (surface field) of such magnets can be between 13,800 gauss (N42) and 14,800 gauss (N52) (1.38 tesla to 1.48 tesla), with a surface net pull-force up to 15 kg (33 pounds) depending on the size of the magnet. The surface field is the strength of the magnetic field measured right at the surface of the magnet. For comparison, the Earth's magnetic field at its surface ranges from 25 to 65 microteslas (0.25 to 0.65 gauss), and will, therefore, have negligible impact on the performance of the current invention.

BACKGROUND OF THE INVENTION

The present invention is a unique and useful device to solve the long-term (>20 years) problem of increasing the sleep or dwell time of a competitive or novelty yo-yo. International patent application WO 2004004859 A1 (Spinning Toy with Attracting Means) describes a yo-yo having annular magnets attached to the ends of its axle for picking up ring objects made of a yieldable material and having magnetic portions.

U.S. Pat. No. 8,764,509 describes a yo-yo having side caps attached to the outside of each half of the yo-yo, configured to rotate independently about the main axis of the yo-yo. Each side cap includes a magnetic weighting element that enables a user to perform tricks with the yo-yo. It may be noted that U.S. Pat. No. 8,764,509 refers to enhanced grind rings enabling the user to perform longer grinds, which are tricks where the yo-yo touches the user's hand.

U.S. Pat. No. 9,440,157 B1 describes an alternate yo-yo capable of being electrically accelerated when held by hand comprising two spinning bodies, a connector connecting the two spinning bodies as a whole, side shaft sleeves provided at center positions of outer sides of the spinning bodies, an electrical acceleration mechanism provided inside the spinning bodies, and a bearing disposed between the two spinning bodies for winding a yo-yo string. An electrical acceleration mechanism is connected to the spinning bodies. Only when the spin speed is high enough, one grabs the yo-yo string and releases the yo-yo; the player can then have sufficient time to perform various yo-yo tricks. Further, it is proposed the yo-yo can be re-accelerated when its spin speed is too slow. When the side shaft sleeves are not grabbed, the electrical acceleration mechanism stops operating while the yo-yo continues to spin due to inertia.

U.S. Pat. No. 5,506,459 describes a magnetically-balanced spinning apparatus having an upright rotating shaft assembly balanced by circumscribing magnets. The rotating shaft assembly is constructed from a single shaft with at least two magnets mounted thereon in a spaced apart relationship. The rotating shaft assembly is balanced on a pivot point at the bottom and spins on a weight bearing surface. A frame having side support magnets generally circumscribes the rotating shaft assembly wherein the support magnets and the rotating magnets of the rotating shaft assembly react to repel each other thereby balancing the rotating shaft assembly in a vertical orientation, and simultaneously levitating the rotating shaft assembly to minimize the effects of gravity thereon.

U.S. Pat. No. 3,326,610 discloses a permanent magnet bearing applicable for supporting the rotating element of an electric meter and suggests that it may be used as a bearing for a variety of precision devices. Magnetic bearings are common in electrical measuring devices wherein the attraction forces between unlike magnetic poles or the repelling forces between like magnetic poles are used for rotatably supporting one element of the measuring device with respect to another element of the device. The particular construction of the electrical measuring device makes the use of the repelling forces between like magnetic poles the most convenient to incorporate within the magnetic support bearing.

U.S. Pat. No. 4,382,245 describes a dish-shaped magnet with an upper surface of a first polarity and a lower surface of a second polarity disposed in co-axial relationship to a second magnet having the opposite polar relationships. The magnetic fields in one form of the apparatus positions the second magnet in spaced relation to the dish-shaped magnet. The apparatus has application as a novelty as well as for gyroscopic and other instrumentation apparatus wherein friction must be minimized. The upper magnet may be rotated either manually or by associated apparatus to provide gyroscopic stability.

International patent application WO 2008002167 A1 describes a modified classical spinning top comprising a coaxially-mounted permanent magnet on its spinning axis. A second permanent magnet with the opposite polarity is manually moved above the top to drive the spinning top in a horizontal direction.

U.S. Pat. No. 6,162,109 discloses that many yo-yo tricks require the yo-yo to spin freely at the end of a string without climbing up the string. A yo-yo spinning freely at the end of the string is commonly said to "sleep" or "dwell." Ideally, a user will cause the yo-yo to sleep, and perform the desired trick while the yo-yo is sleeping. In a "responsive" yo-yo, after the trick has been executed, the user tugs the string and the yo-yo climbs up the string again (referred to herein as "waking up" the yo-yo). A "non-responsive" yo-yo requires the use of response pads with which the string comes in contact during a "bind" in order to get the yo-yo to rewind the string and return to the user's hand; it will not "wake up" with a tug on the string. The spinning is necessary in equal parts for allowing sleeping and returning with the bind. While it becomes increasingly easier to make the yo-yo sleep as the friction forces between the string and the yo-yo are decreased, it also becomes increasingly difficult to wake up the yo-yo and cause it to climb up the string from a sleeping condition. Thus, the friction forces between the string and axle must be adjusted to accommodate the skill level of the user and the types of tricks to be performed.

U.S. Pat. No. 8,053,940 describes a magnetic motor generator that produces electric power by rotating a one-piece magnetic floating flywheel assembly that is operated by a linear induction motor and repelled upward by a stationary natural magnet. The floating flywheel assembly magnetic axle rotates inside magnetic collar bearings, which have repelling stationary magnets to center the axle at speed. The floating flywheel assembly rotors move inside generator stators to generate electric power. The floating flywheel assembly has no physical contact with other components to prevent bearing losses at speed. A timing computer controls the operation of the linear induction motor, assesses the speed of the floating flywheel assembly, and fires only when necessary to maintain rotation. The moving components are enclosed in a vacuum chamber to prevent wind resistance, or windage losses at speed.

Passive Magnetic Bearing Development, by Mark Siebert, University of Toledo, and NASA Glenn Mechanical Components Branch (May 2002), https://www.grc.nasa.gov/WWW/spacemech/workshop02/mag-brg.html, discloses a study on a 100 percent passive magnetic flywheel rig with no active control components. Flywheel energy storage systems are being considered as efficient energy storage devices for use on unmanned, low earth orbit satellites. These systems are expected to provide five to ten times improvement in specific energy storage capacity with longer life than current battery systems. Low-loss magnetic bearings will be needed to support the flywheel rotor. For smaller satellites, they investigated a simple system that used only passive magnets for radial bearing support and jewel bearings for axial support. The objective was to determine whether the bearing system had sufficient stiffness and damping built in to allow performance over the required speed range.

BRIEF SUMMARY OF THE INVENTION

The present invention addresses the long-felt need, not yet realized, for a yo-yo having an uninterrupted long-lasting (>3 min) spin time. This can now be achieved by mounting permanent magnets to the yo-yo's yoke with all the same poles (e.g., either north (N) or south (S)) facing outward. The physical shape and size of each magnet, its placement, and its magnetic strength (gauss level) are carefully chosen and prepared to minimize wobbling. Around the preferred configuration is an H-shaped bearing with magnets having a matching pole (north or south) facing inward so the two sets of magnets repel each other. In addition to these sets of magnets, the yoke may be kept from wobbling horizontally by means of magnets on the outer sides of the yoke, and confronting magnets on the inside of each yo-yo half, with matching poles to repel each other, thereby holding the yoke in place horizontally between the two halves. It is thus an object of the invention to allow for a truly free movement yo-yo to enhance spin rate and spin time to consistently conduct tricks.

It was found by US-NASA-TAMU-EEC (Texas A&M)—Engineering Education College (EEC) that application of recent technology to prepare magnets of nearly identical magnetic strength (+/−10 gauss out of 11,000-15,000 gauss) can be achieved by using the "knocking down" technique applying a pulsed magnetic field in the opposite direction (north vs south) of greater than 4 Tesla (40,000 gauss). This approach has been accurately modeled using Finite Element Analysis (FEA). The FEA modeling of products and systems was conducted in a virtual environment, for the purpose of finding and solving potential (or long existing) structural or performance issues. FEA is the practical application of the Finite Element Method, used by engineers and scientists to mathematically model and numerically solve complex structural, fluid, and multiphysics problems. In addition, the size of such permanent magnets (PM) can be now be controlled to within 0.2%, allowing for secure seating, minimal wobbling, and an added consistent magnetic field.

These, and other objectives of the invention, may be achieved by a yo-yo comprising first and second side members (or halves) defining a string gap there between; an axle extending longitudinally between and securing the side members in fixed relation to each other; and a yoke supported magnetically in non-contact relation about the axle for substantially frictionless rotation about a longitudinal axis of the axle; the yoke further supported magnetically in non-contact relation between the side members; and a string interconnected with and windable around the yoke. The yo-yo may further comprise first and second radially-magnetized ring magnets received within internal cavities within the first and second side members; and first and second radially-magnetized ring magnets received within internal cavities within opposite ends of the yoke; the respective ring magnets of the yoke received in non-contact relation radially interior of the respective ring magnets of the side members; the yoke ring magnets having their magnetic poles configured to repel corresponding magnetic poles of the side member ring magnets. The yo-yo may further comprise first and second axially-magnetized magnetic portions affixed to interior sides of the first and second side members; and first and second axially-magnetized magnetic portions affixed to the exterior sides of the magnetically supported yoke; the respective magnetic portions affixed to the side members having their magnetic poles configured to repel corresponding magnetic poles of the magnetic portions affixed to the exterior sides of the magnetically supported yoke.

DETAILED DESCRIPTION OF THE INVENTION

Figure 1A:
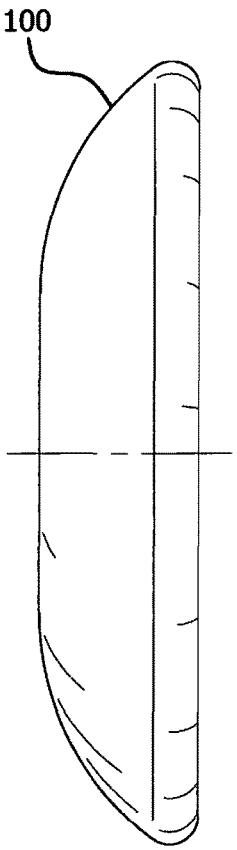
FIG. 1A is a front elevation view of a left side body segment of a preferred embodiment of a yo-yo.

The present invention is described in detail with reference to the drawing figures. The drawings are presented for illustration only and depict a preferred embodiment of the invention. These drawings are presented so that one skilled in the art may assemble a yo-yo having a fixed axle and a magnetically levitated yoke. The novel design and means to accomplish sustained levitation preferably uses ring magnets having specific and consistent physical size so as to achieve consistent magnetic intensity and minimize wobble. The present invention uses ring magnets versus bar magnets. Variations in magnet size (+/−0.05 mm, or 0.2%) affect magnetic field strength and width of magnetic field distribution. For example, at a magnetic field strength of 15,000 gauss (1.5 Tesla), it is desired to the field strength to a consistency within +/−10 gauss at specific distances to optimize performance. The desired strength of the magnetic field may be achieved by using the "knocking down" technique, i.e., by applying a pulsed magnetic field in the opposite direction at a magnitude of >4 tesla (40,000 gauss). The ring magnets may be glued and/or force fit into machined receptacles or cavities.

Figure 1B:
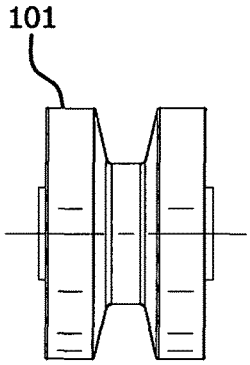
FIG. 1B is a front elevation view of a yoke of the preferred embodiment of the yo-yo.
Figure 1C:
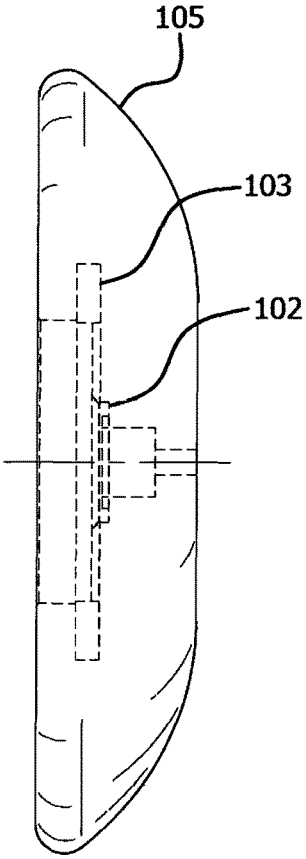
FIG. 1C is a front elevation view of a right side body segment of the preferred embodiment of the yo-yo showing internal cavities.
Figure 1D:
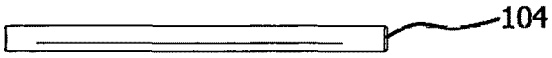
FIG. 1D is a front elevation of an axle of the preferred embodiment of the yo-yo.

FIGS. 1A-1D show front elevation views of a preferred embodiment a yo-yo of the invention. FIG 1A is a front elevation view of a left side body segment 100 of the yo-yo. FIG. 1C is a front elevation view of a right side body segment 105 of the yo-yo. These body segments (left and right) contain similar components. FIG. 1B is a front elevation view of yoke 101 of the yo-yo wherein selected magnets are situated that interact with corresponding magnets in the body segments 100, 105 to levitate the yoke 101. Internal cavities 102, 103 may be machined into the body segments 100, 105 to house ring magnets for a magnetic bearing. FIG. 1D is a front elevation view of a fixed axle 104 that connects the two body segments 100, 105 without formal connection to the yoke 101. An area within the center of the yoke 101 is where magnetic levitation or magnetic suspension is achieved with no added support other than by means of ring magnetic fields. These magnetic forces are used to counteract the effects of frictional forces when initiating the spin of the yo-yo. A string (not shown) may be wound around the yoke 101.

Figure 2A:
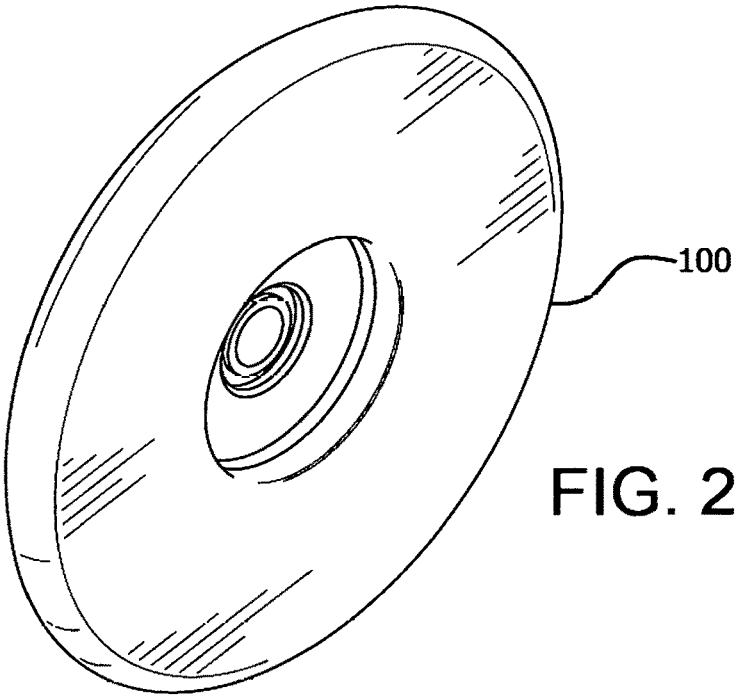
FIG. 2A is a perspective view of the left side body segment.
Figure 2B:
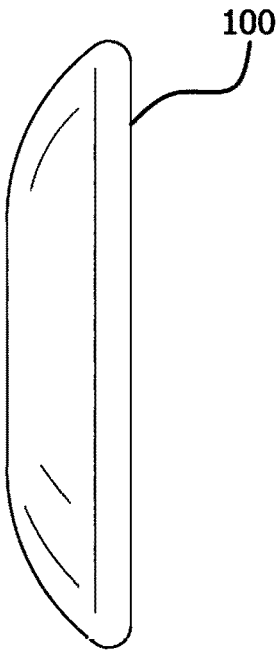
FIG. 2B is a front elevation view of the left side body segment of of FIG. 2A.
Figure 2C:
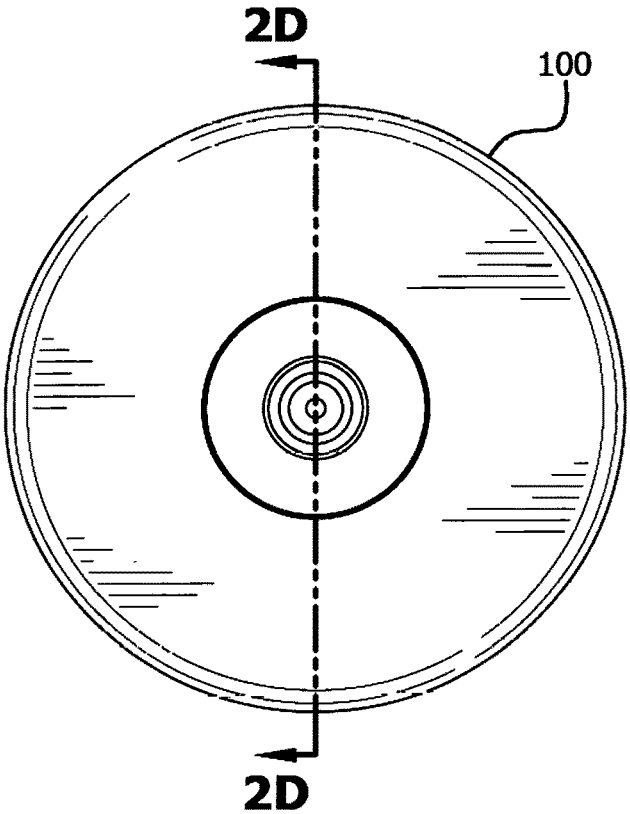
FIG. 2C is a right-side elevation view of the left side body segment of FIG. 2A.
Figure 2D:
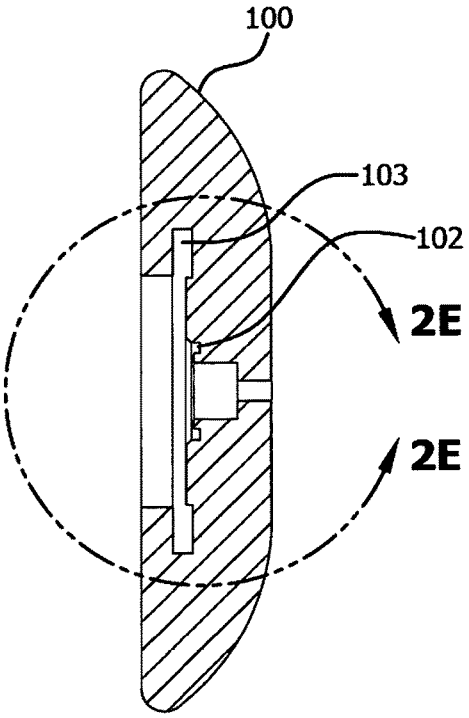
FIG. 2D is a cross-sectional view of the left side body segment taken along the line and in the direction indicated by the arrows 2D-2D in FIG. 2C.
Figure 2E:
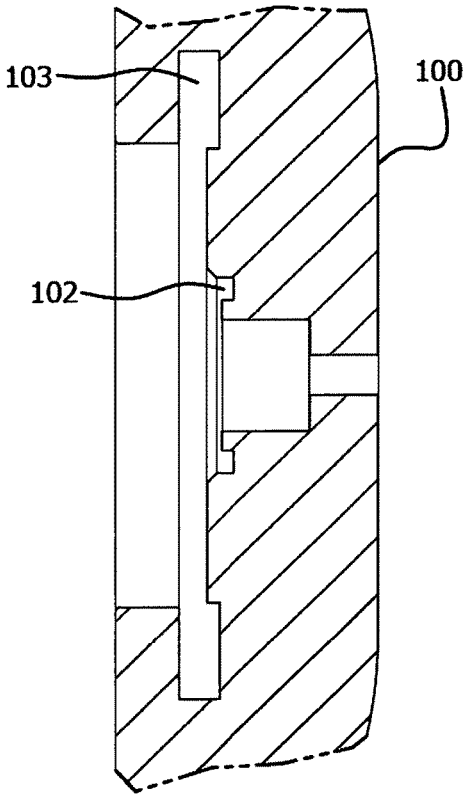
FIG. 2E is an enlarged cross-sectional view of a portion of the left side body segment of taken about the circular line 2E-2E of FIG. 2D.
Figure 5A:
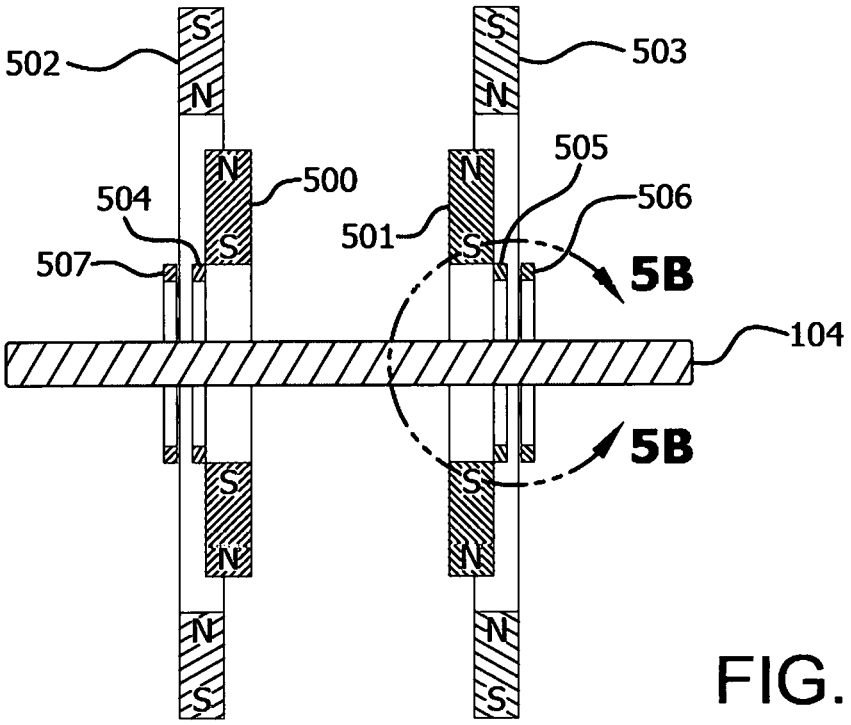
FIG. 5A is a front elevation view in cross-section of the ring magnets of the yo-yo of FIG. 4A along with the axle.
Figure 5B:
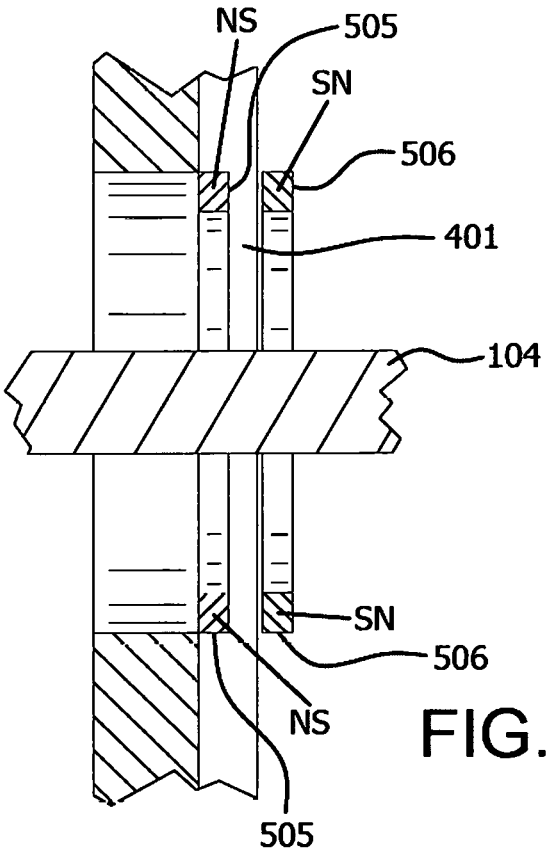
FIG. 5B is an enlarged view in cross-section of a portion of the magnets and axle of FIG. 5A taken about the line 5B-5B of FIG. 5A.

FIG. 2A shows a perspective view of the left side body segment 100 revealing internal cavities. FIG. 2B shows a front elevation view of the left side body segment 100 of FIG. 2A. FIG. 2C shows a side elevation view of the left side body segment 100 of FIG. 2A. In this embodiment, the left and right side body segments 100, 105 may be identically constructed and arranged in confronting relationship so as to mirror each other. FIG. 2D shows a front elevation view of the left side body segment in section taken along the line 2D-2D in FIG. 2C. FIG. 2E shows an enlarged portion of the body segment 100 in cross-section taken about the line 2E-2E of FIG. 2D. Portions 102, 103 may be internal cavities or pockets configured to receive ring magnets 506, 503, respectively, shown in FIG. 5A. The ring magnets 506, 503 may be force fit and/or glued into cavities 102, 103, respectively, so as to minimize wobble and magnetic field distortion. The positions and magnetic field polarities (north or south) of each ring magnet 506, 503 may be as shown in FIGS. 5A and 5B.

In FIGS. 2D, 2E there is shown a front elevation view of the yo-yo left side member 100 shown in cross-section. The side members 100 and 105 may define cup-shaped portions having thin sidewalls and may be made of a lightweight yet strong material such as titanium. Although the details for the right side member 105 (FIG. 1C) are not shown here, it is essentially identical in structure to the left side member 100, as may be seen in FIG. 4B. The side members may have rims made of a heavy material such as stainless steel. The yo-yo may have its mass distributed preferentially towards the outermost portions of side members 100 and 105 to achieve a favorable moment of inertia for the yo-yo. The first and second side members 100, 105 may define first and second interior sides, respectively, facing each other. The first and second interior sides may define first and second magnetic portions respectively that face each other and confront the first and second exterior sides of the magnetically supported bearing yoke 101, respectively. The first and second side members 100, 105 and the axle 104 may be supported to freely rotate about a longitudinal axis of the axle 104 and the yoke 101, and to freely move from side-to-side longitudinally along the length of the yoke 101, constrained only by magnetic forces that repel the magnetic portions of the yoke 101 sides from the magnetic portions of the interior sides of the body side members 100, 105.

The outside of the yo-yo may be made of titanium walls, as thin as possible, allowing for optimum weight distribution. The rims of the walls may be made of high-quality stainless steel (for example, preferably Grade 300 Level (non-magnetic), but not Grade 400 Level (that is magnetic), nor Grade 200 Level, containing low nickel content, referred to as chrome-manganese (CrMn) stainless steel (and non-magnetic)), or another dense material so that there is added weight on the outside.

The invention, in a preferred embodiment, may use NdFeB magnets (neodymium, iron, and boron), that can be precisely "knocked down" using a pulsed magnetic field to the desired magnetic field strength to within +/−10 gauss. It has been discovered that the ring magnets perform at their optimum when their dimensions are within a narrow error limit, and the magnetic field strength per magnet is as identical as possible (ideally +/−10 gauss), so as to limit wobbling. The magnetic field strength (surface field) of such magnets may be between 13,800 gauss (N42) and 14,800 gauss (N52) (1.38 tesla to 1.48 tesla), with a surface net pull force of approximately 15 kg (33 pounds). For magnets, the higher the "N" number (e.g. N52), the stronger the magnet. The stored energy in a magnet, called magnet performance or maximum energy product (often abbreviated $BH_{max}$), is typically measured in units of megagauss-oersteds (MGOe). One MGOe is approximately equal to 7957.74715 J/m$^3$. Neodymium magnets produce the highest MGOe of any permanent magnet material. The most common grades of Neodymium magnets are N35, N38, N40, N42, N45, N48, N50, N52, and N55. If weaker (<10,000 gauss) magnets were used, such as magnets made from aluminum, nickel, and cobalt, the magnets might be incapable of supporting the yoke, stopping the spin almost instantly. NdFeB magnets are also superior because they prevent the most movement, making tricks significantly easier. Samarium-Cobalt magnets may be used but are not ideal because they are less amenable to being "knocked down" to a precisely desired magnetic field strength.

Figure 3A:
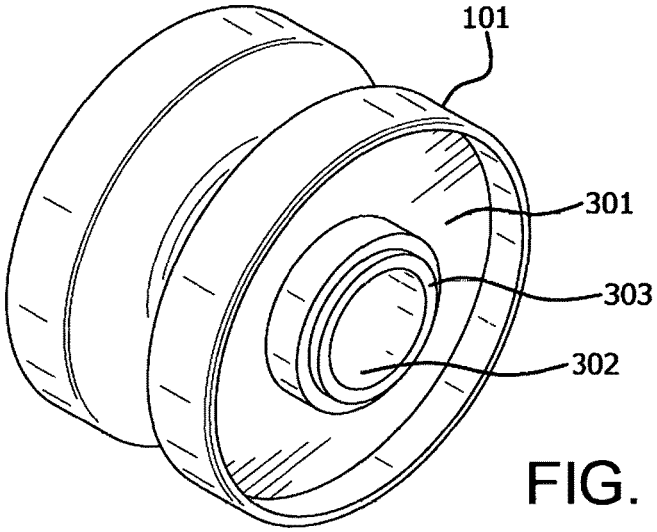
FIG. 3A is a perspective view of the yoke of FIG. 1B.

FIG. 3A is a perspective view of the yoke 101. The yoke 101 includes a pocket or cavity 301 which may house a magnet 503 that tends to inhibit radial sliding or movement (wobble). Greater detail of the yoke 101 may be seen in FIGS. 3B, 3D, 4A, and 4B.

Figure 3B:
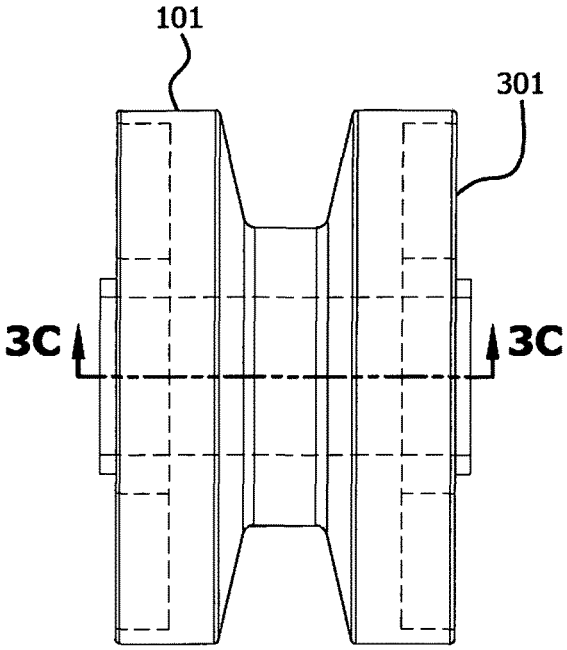
FIG. 3B is a front elevation view of the yoke of FIG. 3A showing internal cavities.
Figure 3C:
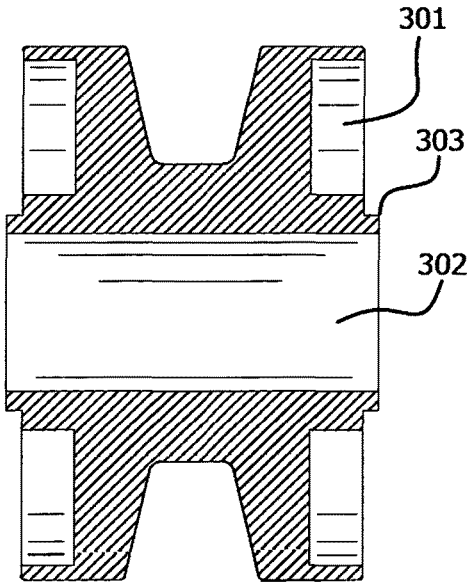
FIG. 3C is a front elevation view of the yoke in cross-section taken along the line and in the direction indicated by the arrows 3C-3C in FIG. 3B.

FIG. 3B is a front elevation view of the magnetically supported bearing yoke 101. The magnetically supported bearing yoke 101 includes the cavity 301, configured to receive the magnet 501. FIG. 3C is a front elevation view of the yoke 101 in cross-section taken along the line 3C-3C in FIG. 3B. The right end of the yoke 101 defines a boss 303 about which a ring magnet 505 (FIGS. 5A, 5B, 6A) is attached. Another ring magnet 504 (FIGS. 5A, 6A) is attached to the left end of the yoke 101 in an identical fashion. The first and second magnetic portions (507, 506) of the side members (100, 105) may have magnetic fields oriented parallel to a longitudinal axis of the axle 104.

Figure 4B:
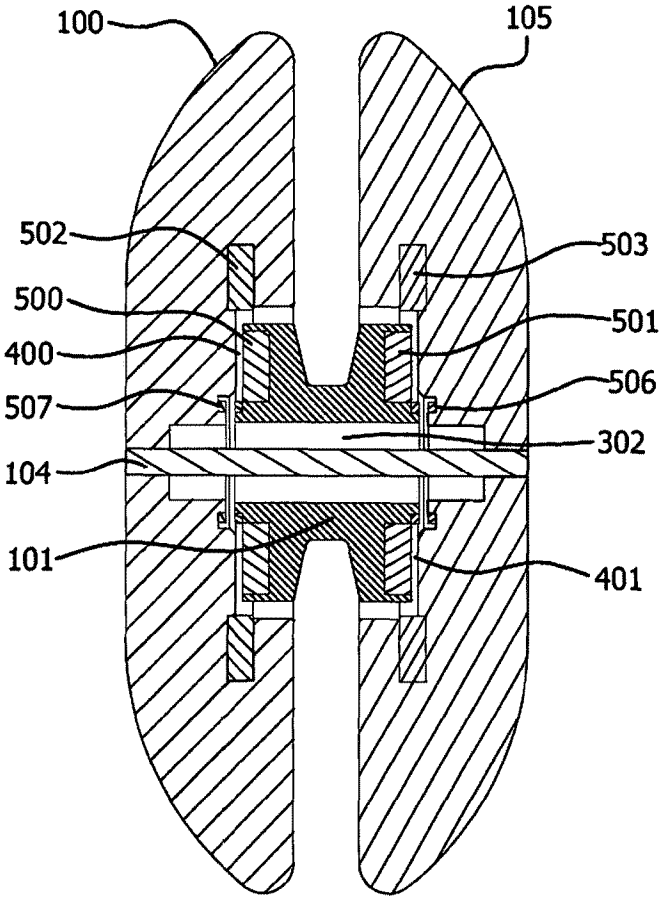
FIG. 4B is a front elevation view of the yo-yo of FIG. 4A in cross-section taken along the line and in the direction indicated by the arrows 4B-4B in FIG. 4A.

In FIGS. 4B, 5A, 5B, it may be seen that cavity 301, on the right side of the yoke 101 of FIG. 3C, receives the ring magnet 501, to produce levitation of the yoke 101 about the axle 104, in combination with the ring magnet 503, within the side member 105. It was found that it was desirable to have the ring magnet 503 offset longitudinally, relative to the ring magnet 501, to achieve consistent levitation. Similarly, the left side member 100 is configured in the same manner to generate levitation of the yoke 101 about the axle 104, with the ring magnet 500 longitudinally offset from the ring magnet 502. The offset may be seen in FIGS. 4B, 5A, 6A, and 6B.

Figure 4A:
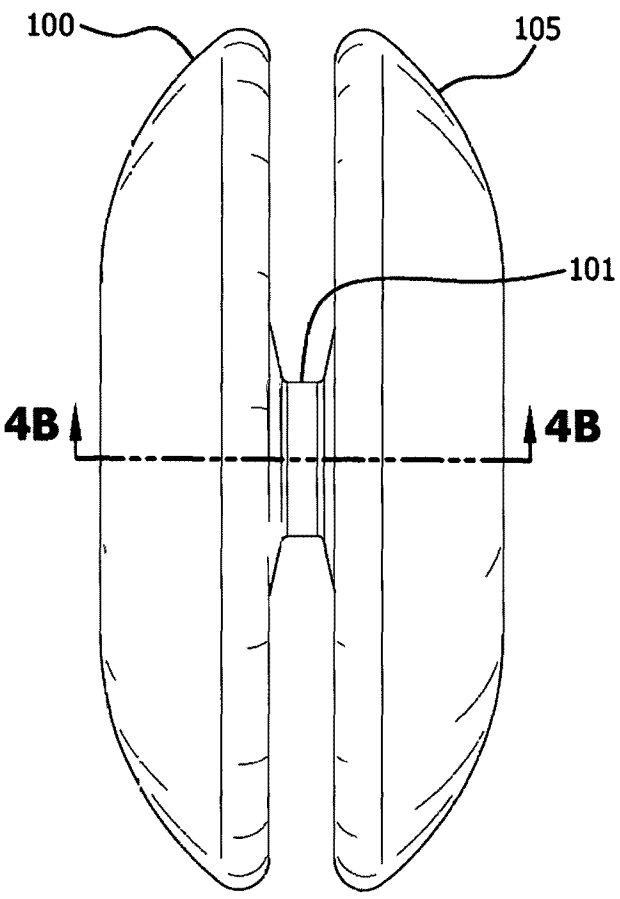
FIG. 4A is a front elevation view of a yo-yo embodiment.

FIG. 4A is a front elevation view of an embodiment of the yo-yo showing the left and right side body members 100, 105, and the yoke 101. FIG. 4B is a front elevation view of the yo-yo of FIG. 4A in cross-section, taken along the line 4B-4B shown in FIG. 4A. The right side body member 105 may define the internal cavities 102 and 103. The internal cavities 102 and 103 may receive ring magnets 506 and 503, respectively. In a similar manner, the left side body may define internal cavities configured to receive like ring magnets 507, 502. The yoke 101 may include the internal cavity 301 and the boss 303 that may be configured to receive the ring magnet 501 and the ring magnet 505, respectively. In a similar manner, the opposite end of the yoke 101 may define a cavity and a boss for receiving like ring magnets 500, 504. The permanent ring magnets 500, 501 may be mounted to the ends of the yoke 101 with all the same magnetic poles (e.g., either north (N) or south (S)) facing radially outward, as shown in FIGS. 5A and 5B. The physical shape and size of each magnet, its placement, and its magnetic field strength (gauss level) are preferably chosen and mechanically prepared so as to minimize wobbling. Around the preferred configuration is a generally H-shaped bearing comprising ring magnets 502, 503 having matching poles (e.g., either north or south) facing radially inwardly so that the two sets of magnets repel each other. In addition to these sets of magnets, the yoke 101 may be kept from wobbling horizontally (longitudinally) by means of magnets 505, 504 on the outer sides of the yoke 101, and confronting magnets 506, 507 on the inside of each yo-yo side member 105, 101, with matching poles to repel each other, thereby tending to hold the yoke 101 in place horizontally between the two side members 100, 105.

In FIG. 4B, there is shown a front elevation view of the yo-yo, having side members 100, 105, with the first and second side members 100, 105 shown in cross-section. The side members 100, 105 may define cup-shaped or disk-shaped portions having thin sidewalls and may be made of a lightweight yet strong material such as titanium. The side members 100 and 105 may have rims made of a heavy material such as stainless steel. The yo-yo may have its mass distributed preferentially towards the outermost portions of the side members 100 and 105 to achieve a favorable moment of inertia for the yo-yo. The first and second side members 100 and 105 may define first and second interior sides, respectively, facing each other. The side members 100, 105, in cooperation with the yoke 101, may define spaces 400, 401 therebetween to allow sufficient room for levitation of the yoke 101 along a longitudinal axis. Each space 400, 401 may run from the bottom to the top of each side member 100, 105, which allows for levitation of the yoke 101 along a radial axis about the axle 104. The yoke 101 may define a generally cylindrical interior volume or space 302 that surrounds the fixed axle 104. The first and second interior sides of the side members 100, 105 may define first and second magnetic ring portions 507, 506, respectively, that face each other, and confront corresponding first and second magnetic ring portions 504, 505 on corresponding first and second exterior sides or ends of the magnetically-supported yoke 101, respectively. The yoke 101 may be magnetically-supported to freely rotate about the axle 104, and to freely move from side-to-side longitudinally along the length of the axle 104, constrained only by magnetic forces that repel the magnetic portions 504, 505 of the yoke 101 exterior sides from the magnetic portions 507, 506 of the interior sides of the body side members 100, 105.

The yo-yo makes novel use of ring magnets to provide extended sleep and dwell times. Ring magnets have north and south poles, as do bar magnets, but the magnet is curved or circular, with an open center, such that the poles lie in the same plane. Basic ring magnets can be magnetized with their north and south poles on opposite circular faces, such as the axially-magnetized ring magnets 504, 505, 506 and 507. The magnetic field lines of these magnets are oriented perpendicularly to their axial faces and parallel to the longitudinal axis of the axle 104. Axially-magnetized ring magnets 505, 506 may have their south poles oriented inwardly towards each other, and their north poles oriented outwardly away from each other, as shown in FIG. 5B. Likewise, ring magnets 504, 507 may have like poles oriented toward each other. Of course, the magnetic polarities of each of the ring magnets 505, 506, 504, 507 may have the opposite orientations to what has been shown herein.

In contrast, a true radially-magnetized ring magnet has unique poles (south (S)/north (N)), for example, but the south pole may be on the outside circumference and the north pole may be on the inside circumference of the ring, as is the ease for the ring magnets 502, 503, or the north pole may be on the outside circumference and the south pole on the inside circumference of the ring magnet, as is the case for the ring magnets 500, 501. The magnetic field lines of these magnets are oriented perpendicularly to their circumferential faces and perpendicular to the longitudinal axis of the axle 104. Of course, the magnetic polarities of each of the ring magnets 502, 503, 500, 501 may have the opposite orientations to what has been shown herein.

FIG. 5A is a front elevation view in cross-section of the ring magnets of the yo-yo of FIG. 4A along with the axle. FIG. 5B is an enlarged view in cross-section of a portion of the magnets and axle of FIG. 5A taken about the line 5B-5B of FIG. 5A. The yoke magnets 500, 501 may be radially-magnetized with their north poles extending radially outward from their outer circumferential faces and their south poles extending radially inward from their inner circumferential faces. The body (or side member) magnets 502, 503 may be radially-magnetized with their north poles extending radially inward from their inner circumferential faces and their south poles extending radially outward from their outer circumferential faces. The body magnets 502, 503 may repel the yoke magnets 500, 501, respectively, so as to tend to keep the yoke centered about the axle 104. The yoke centering magnets 504, 505 may be axially-magnetized with their south poles extending axially outward from their exterior side faces and their north poles extending axially inward from their interior side faces. The body (or side member) centering magnets 507, 506 may be axially-magnetized with their south poles extending axially inward from their exterior side faces and their north poles extending axially outward from their interior side faces. The body centering magnets 507, 506 may repel the yoke centering magnets 504, 505, respectively, so as to tend to keep the yoke 101 centered between the side members 100, 105.

Figure 6A:
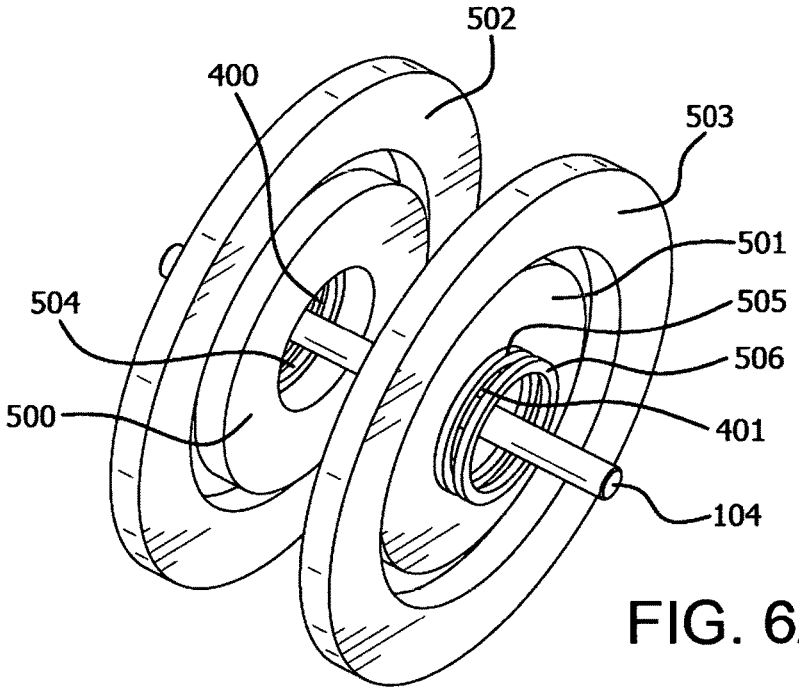
FIG. 6A is a perspective view of the ring magnets and the axle of FIG. 5A.
Figure 6B:
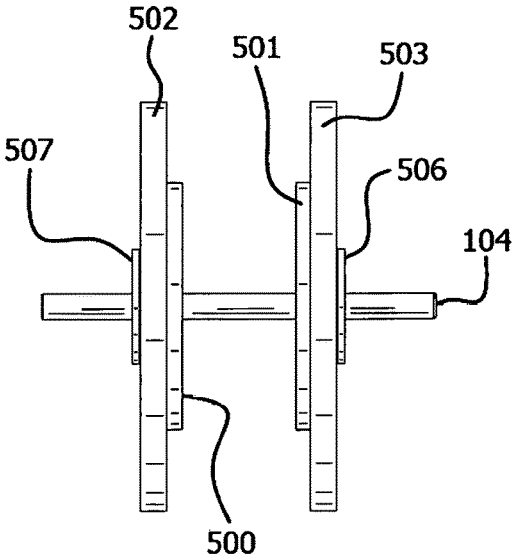
FIG. 6B is a front elevation view of the ring magnets and the axle of FIG. 6A.
Figure 6C:
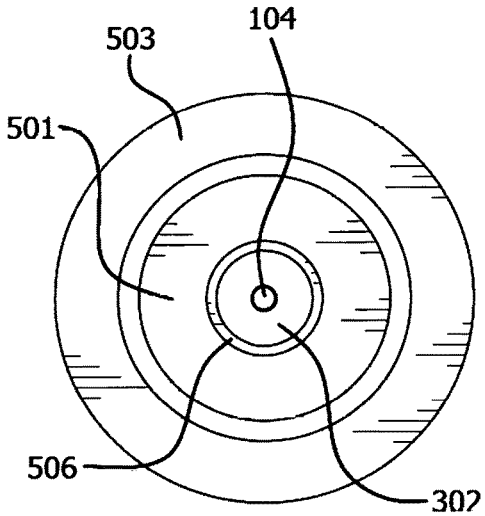
FIG. 6C is a right side elevation view of the ring magnets and the axle of FIG. 6A.

FIG. 6A is a perspective view of the ring magnets and the axle of FIG. 5A. FIG. 6B is a front elevation view of the ring magnets and the axle of FIG. 6A. FIG. 6C is a right side elevation view of the ring magnets and the axle of FIG. 6A, looking in toward one end of the yoke and axle combination. Radially-magnetized yoke ring magnets 500 and 501 may be received radially interior of the radially-magnetized body member ring magnets 502 and 503, respectively. The yoke ring magnets 500 and 501 may be axially offset from the body member ring magnets 502, 503, toward each other. The radially-magnetized yoke ring magnet 501 may interact with the radially-magnetized body member ring magnet 503 to mutually repel each other. The radially-magnetized yoke ring magnet 500 may interact with the radially-magnetized body member ring magnet 502 to mutually repel each other. The magnitude of the repulsion between magnets 503 and 501 and magnets 502 and 500 may be symmetrical about the circumference of the gaps defined therebetween. The mutually repulsive forces between the yoke magnets 500, 501 and the body member magnets 502, 503 tend to stabilize the yoke 101 against movements in directions perpendicular to the longitudinal axis of the axle 104. Preferably, the magnetic field strengths are uniform, consistent (within +/−10 gauss), and at a fixed field strength of about 15,000 gauss.

Similarly, the axially-magnetized yoke ring magnets 504 and 505 may be configured to axially confront the axially-magnetized ring magnets 507 and 506, respectively, in spaced relationship to thereby define gaps 400 and 401, respectively. The axially-magnetized yoke ring magnet 504 may interact with the axially-magnetized body member ring magnet 507 to mutually repel each other. The axially-magnetized yoke ring magnet 501 may interact with axially-magnetized ring magnet 506 to mutually repel each other. The magnitude of the repulsion between the magnets 504 and 507, and the magnets 505 and 506, may be symmetrical about the circumference of the gaps 400 and 401 between them. The mutually repulsive forces between the yoke magnets 504, 505 and the body member magnets 507, 506 tend to stabilize the yoke 101 against movements in directions parallel to the longitudinal axis of the axle 104. Consequently, the yoke 101 will tend to float freely within the yo-yo for rotational movement about the axle 104.

While the foregoing written description of the invention enables one of ordinary skill to make and use what is considered to be the best mode of the invention, those of ordinary skill will understand and appreciate the existence of variations, combinations, and equivalents of the specific embodiments, methods, and examples described herein. The invention should, therefore, not be limited by the above described embodiments, methods, and examples but include all embodiments and methods within the scope and spirit of the invention as claimed.

The invention claimed is:

1. A yo-yo comprising: first and second side members defining a string gap there between; an axle connecting the side members together in spaced relation, the axle defining a longitudinal axis; a magnetically supported yoke received within the side members and surrounding the axle; and a string connected to the yoke for windable receipt around the center of the yoke; wherein the first and second side members are magnetically supported for rotational movement about the longitudinal axis.

2. The yo-yo of claim 1, further comprising: first and second radially-magnetized permanent ring magnets received within the first and second body members, respectively; and first and second radially-magnetized permanent ring magnets disposed about first and second ends of the yoke, respectively, and received radially interior of the first and second radially-magnetized body member ring magnets, respectively; wherein the first and second radially-magnetized side member ring magnets and the first and second radially-magnetized yoke ring magnets are magnetically polarized so as to mutually repel each other.

3. The yo-yo of claim 2, further comprising: first and second axially-magnetized permanent ring magnets received within the first and second body members, respectively; and first and second axially-magnetized permanent ring magnets dispose at the first and second ends of the yoke, respectively, the and confronting the first and second axially-magnetized body member magnets is axially-spaced relation, respectively; wherein the first and second axially-magnetized side member ring magnets and the first and second axially-magnetized yoke ring magnets are magnetically polarized so as to mutually repel each other.

4. The yo-yo of claim 3 wherein the first and second radially-magnetized body member magnets comprise rare earth ring magnets.

5. The yo-yo of claim 4 wherein the first and second radially-magnetized body member magnets comprise neodymium.

6. The yo-yo of claim 3 wherein the first and second radially-magnetized yoke magnets comprise rare earth ring magnets.

7. The yo-yo of claim 6 wherein the first and second radially-magnetized yoke magnets comprise neodymium.

8. The yo-yo of claim 3 wherein the first and second axially-magnetized body member ring magnets comprise rare earth magnets.

9. The yo-yo of claim 8 wherein the first and second axially-magnetized body member ring magnets comprise neodymium.

10. The yo-yo of claim 3 wherein the first and second axially-magnetized yoke ring magnets comprise rare earth magnets.

11. The yo-yo of claim 10 wherein the first and second axially-magnetized yoke ring magnets comprise neodymium.

* * * * *